United States Patent [19]

Maxwell

[11] Patent Number: 4,758,936

[45] Date of Patent: Jul. 19, 1988

[54] LAMP SHADE ASSEMBLY

[75] Inventor: Richard Maxwell, Nutley, N.J.

[73] Assignee: Lusterlon Inc., Edgewater, N.J.

[21] Appl. No.: 869,724

[22] Filed: Jun. 2, 1986

[51] Int. Cl.[4] ..... F21V 11/00

[52] U.S. Cl. ..... 362/352; 362/294; 362/434; 362/353

[58] Field of Search ..... 362/351, 294, 373, 352, 362/353, 358, 433, 434, 437, 438, 439, 441, 442, 435

[56] References Cited

U.S. PATENT DOCUMENTS

| | | | |
|---|---|---|---|
| 785,483 | 3/1905 | Feighner | 362/438 |
| 856,190 | 6/1907 | Baumer | 362/358 |
| 1,570,230 | 1/1926 | Chambers, Sr. | 362/358 |
| 1,745,366 | 2/1930 | Greenberg | 362/358 |
| 2,264,255 | 11/1941 | Burke | 362/358 |
| 2,404,162 | 7/1946 | Brown | 493/276 |
| 2,463,114 | 3/1949 | Klint | 362/358 |
| 2,710,339 | 6/1955 | Targosh | 362/347 |
| 4,075,684 | 2/1978 | Witz | 362/252 |
| 4,541,038 | 9/1985 | VanNoord | 362/351 |

FOREIGN PATENT DOCUMENTS

| | | | |
|---|---|---|---|
| 494570 | 7/1950 | Belgium | 362/358 |
| 72097 | 1/1951 | Denmark | 362/353 |
| 74727 | 9/1952 | Denmark | 362/352 |
| 2606183 | 8/1977 | Fed. Rep. of Germany . | |
| 984027 | 7/1951 | France | 362/351 |
| 72425 | 8/1947 | Norway | 362/351 |
| 391284 | 4/1933 | United Kingdom | 362/351 |
| 907514 | 10/1962 | United Kingdom | 362/358 |

*Primary Examiner*—Ira S. Lazarus
*Assistant Examiner*—D. M. Cox
*Attorney, Agent, or Firm*—Bacon & Thomas

[57] ABSTRACT

A lamp shade assembly is disclosed that is aesthetically pleasing, easy to assemble and one which may be utilized in a variety of orientations to provide either direct or indirect lighting. The assembly has a shade body member having a generally conical configuration which may be attached to a lamp socket. A lamp shade, which may be made of a flexible, expandible material is initially formed in a cylindrical configuration wherein the diameter is less than the maximum diameter of the conical body member, and one end of the shade is placed into the body member. A retaining member is inserted into the interior of the lamp shade so as to urge a portion of the outer surface of the lamp shade material into contact with an inner surface of the body member, thereby forming the lamp shade into a generally conical configuration. A locking collar, threadingly engaged with a lamp socket, holds the retaining member in place against the inner surface of the lamp shade.

18 Claims, 2 Drawing Sheets

Fig. 1
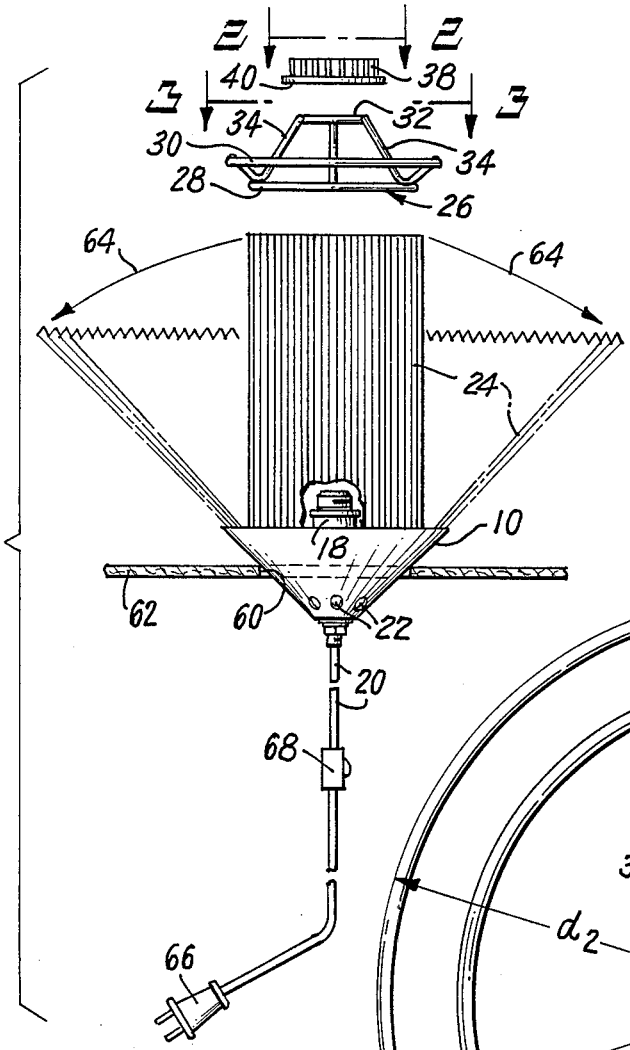
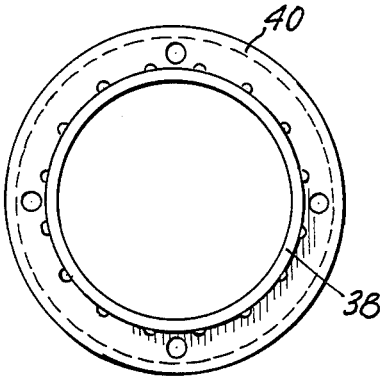
Fig. 2
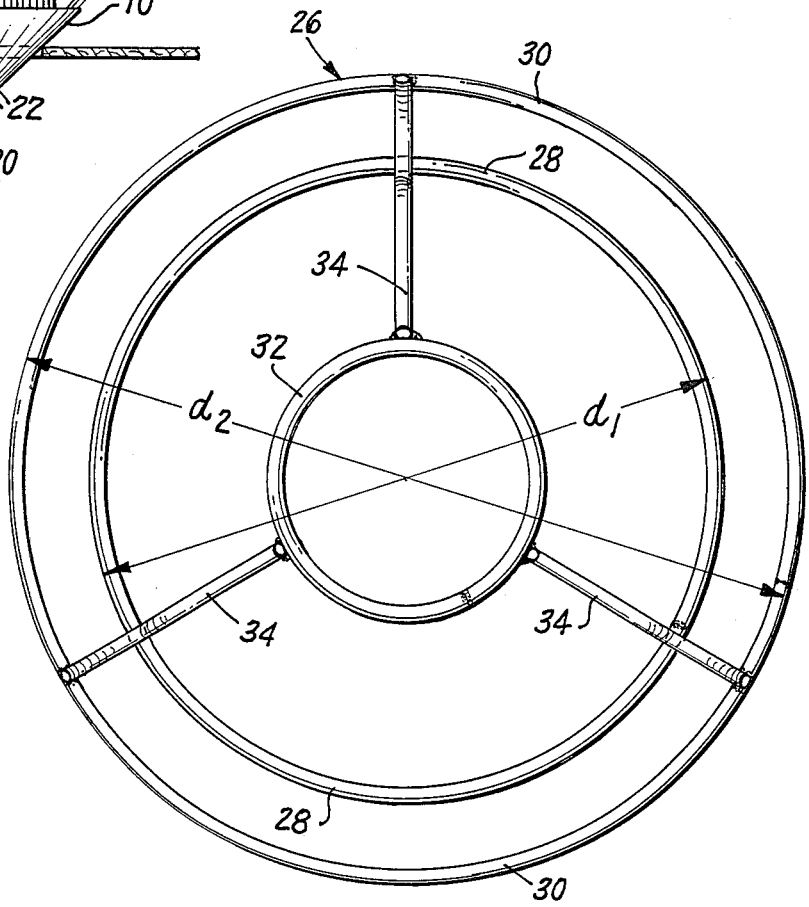
Fig. 3

LAMP SHADE ASSEMBLY

FIELD OF THE INVENTION

The present invention relates to a lamp shade assembly, particularly one which can be easily assembled and used in a variety of orientations.

BRIEF DESCRIPTION OF THE PRIOR ART

It is well known, of course, to fabricate lamp shades in a wide variety of shapes from an equally wide variety of materials. Among the most aesthetically pleasing lamp shade configurations are those having a generally conical configuration formed with generally longitudinally extending pleats. Typically, such lamp shades are fabricated by first forming the pleated, flexible shade material, which may be fabric, paper, etc. into a generally cylindrical configuration with the pleats extending generally parallel to the longitudinal axis of the cylinder. The pleated cylinder is then deformed into a generally conical configuration by attaching it about an interior frame. It is known to fabricate such an interior frame from wire and to attach it to the pleated material by clips, adhesive, thread, etc.

It is also known to attach a removable, decorative exterior frame over the lamp shade to improve the aesthetic effects of the lamp shade and to allow the user to change the appearance of the shade from time to time.

It is also known to form a pleated lamp shade material into a generally conical configuration and attach it to the exterior surface of a generally conical frame by folding over an upper edge of the flexible, pleated material such that it passes into the interior of the conical frame. The conical framework is attached to the lamp structure.

The flexible, pleated lamp shade material may also be attached to a framework similar to that utilized in an umbrella. By attaching the pleated shade to longitudinally extending arms, the conical angle of the shade material may be readily adjusted by a screw thread mechanism.

It is also known to manufacture and sell lamp shades in kit form. Typically, such kits involve a cylindrical, flexible lamp shade material which is placed about the outer portion of a circular framework.

SUMMARY OF THE INVENTION

The present invention relates to a lamp shade assembly that is aesthetically pleasing, easy to assemble and one which may be utilized in a variety of orientations to provide either direct or indirect lighting.

The assembly has a shade body member having a generally conical configuration which may be attached to a lamp socket. A lamp shade, which may be made of a flexible, expandable material is initially formed in a cylindrical configuration wherein the diameter is less than the maximum diameter of the conical body member, and one end of the shade is placed into the body member. A retaining member is inserted into the interior of the lamp shade so as to urge a portion of the outer surface of the lamp shade material into contact with an inner surface of the body member, thereby forming the lamp shade into a generally conical configuration. A locking collar, threadingly engaged with a lamp socket, holds the retaining member in place against the inner surface of the lamp shade.

The lamp and the associated lamp shade may be suspended such that the conically shaped body member and lamp shade open in a downward direction to provide direct lighting, or they may be mounted to a stand such that they open in an upward direction to provide indirect lighting.

BRIEF DESCRIPTION OF THE DRAWINGS

FIG. 1 is an exploded view illustrating the assembly of the shade and lamp.

FIG. 2 is an enlarged plan view of the locking collar taken on line 2—2 in FIG. 1.

FIG. 3 is an enlarged plan view of the retaining ring taken along line 3—3 of FIG. 1.

DETAILED DESCRIPTION OF THE PREFERRED EMBODIMENT

Figure 5:
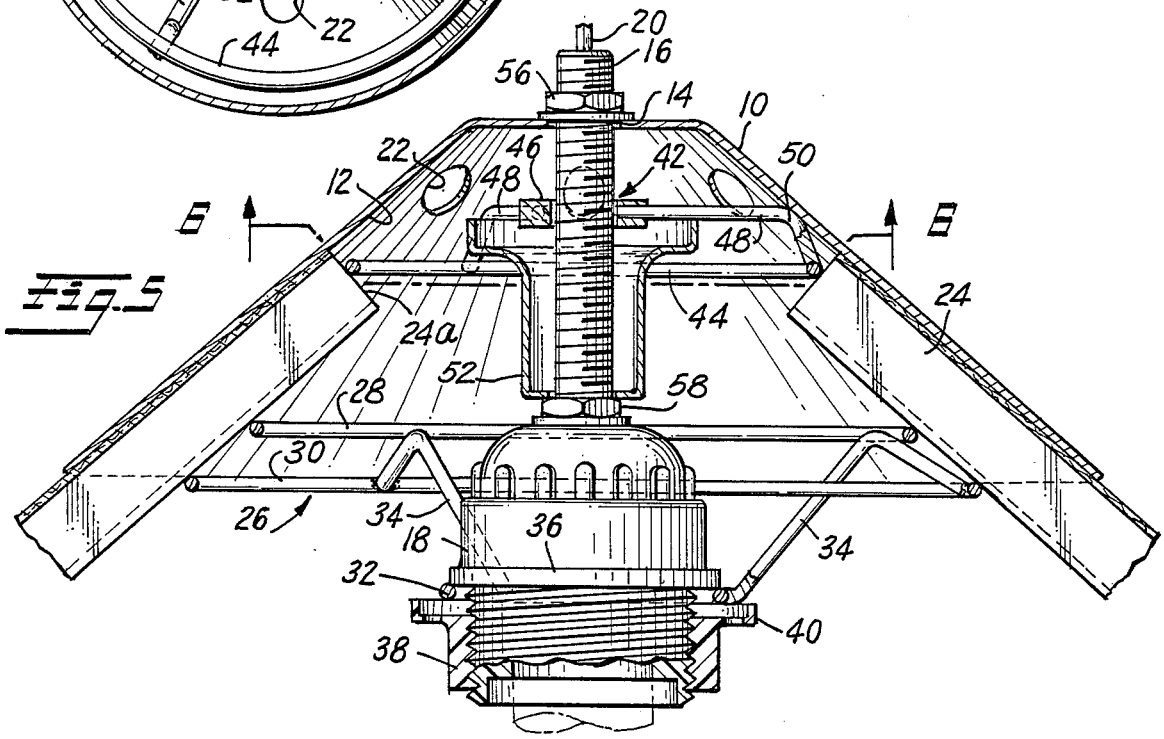
FIG. 5 is an enlarged, partial cross-sectional view of the lamp shade assembly according to the invention taken along the line 5—5 in FIG. 4.

As best seen in FIG. 5, the lamp shade assembly according to the invention has a body member 10 with a generally conical configuration defining an interior surface 12. Although the invention will be described with the body member and the lamp shade having a circular, conical configuration, quite obviously other configurations may be utilized without exceeding the scope of this invention.

Body member 10 defines an opening 14 of sufficient dimensions to slidably pass over threaded portion 16 of light bulb socket 18. Light bulb socket 18 is of standard configuration and may accommodate a single incandescent light bulb of any size. The socket 18 is connected to a source of electrical power via cord 20 connected to socket 18 via known means. Body member 10 also defines a plurality of holes 22 near its apex. When body member 10 is assembled to the lamp socket 18, holes 22 allow the air heated by the light bulb to escape from the enclosed area within body member 10, to facilitate the cooling of the lamp and shade assembly.

Lamp shade 24 is retained within the body member 10 such that at least a portion of a first, outer surface of the shade 24 is in contact with the inner surface 12 of body member 10. Although lamp shade 24 is illustrated as being formed of a flexible, pleated material, it is to be understood that rigid non-pleated material or expandable non-pleated material can also be utilized to form the lamp shade 24 without exceeding the scope of this invention.

The lamp shade 24 is retained in assembled relationship with body member 10 by retaining ring member 26. As best seen in FIG. 5, retaining ring 26 bears against a second, inner surface of lamp shade 24 so as to clamp the lamp shade between it and the inner surface 12 of body member 10. This forces the lamp shade 24 into conical shape, shown in FIGS. 4 and 7, similar to the conical shape of body member 10 which defines an apex angle shown in FIG. 4.

Retaining ring 26 may comprise a first ring 28 having a first diameter $d_1$ and a second ring 30 having a diameter of $d_2$ such that $d_2$ is greater than $d_1$. Third ring 32 is connected to rings 28 and 30 by a plurality of connecting members 34, such that the three rings are substantially parallel to each other. The inner diameter of ring 32 should be of sufficient size to enable this ring to slide over a portion of lamp socket 18 and bear against radially extending flange 36 formed thereon. To hold ring 32 against flange 36, locking collar 38 is threadingly engaged with a portion of lamp socket 18 and bears against ring 32 so as to clamp this ring between the locking collar and flange 36. To facilitate the clamping effect, locking collar 38 may also have radially extending flange 40 formed thereon.

Spacer member 42 is interposed between end 24*a* of lamp shade 24 and body member 10. Spacer member 42 comprises ring 44 and hub 46 interconnected by a plurality of radial arms 48. Arms 48 are curved near their outer ends so as to bear against inner surface 12 of body member 10 at curved portions 50. Hub 46 defines an opening therethrough of sufficient dimensions so as to allow the spacer member 42 to slide over threaded portion 16 of lamp socket 18. Spacer collar 52 is interposed between lamp socket 18 and the radial arms 48 to maintain the spacer member 42 in contact with body member 10. By tightening nut 56, the spacer collar 52 is urged against nut 58 so as to retain the parts in assembled relationship.

The method for assembling the lamp and shade is illustrated in FIG. 1. The body member 10 along with socket 18 are oriented such that both face upwardly. Body member 10 may be inserted into an opening 60 defined in support member 62 to facilitate holding body member 10 in its upward orientation. Support member 62 may be formed from any rigid material, such as cardboard or the like, and may also serve as a part of a carton in which the lamp assembly is shipped or otherwise transported.

Prior to the attachment of body member 10 with the lamp socket 18, it is understood that spacer collar 52 along with spacer member 42 are inserted over threaded portion 16 of the lamp socket 18 to assume the positions shown in FIG. 5.

End 24*a* of lamp shade 24, having a generally cylindrical configuration as shown in FIG. 1, is inserted into body member 10 so as to surround lamp socket 18. Retainer member 26 is then inserted through the distal opening of lamp shade 24 and is pressed downwardly through the interior of the lamp shade until it clamps the lower portion of the lamp shade against the inner surface 12 of body member 10. This forces the distal end portion of lamp shade 24 radially outwardly in the direction of arrows 64, such that lamp shade 24 assumes a conical shape. Locking collar 38 is then screwed onto lamp socket 18 so as to clamp ring 32 between flanges 36 and 40. As shown in FIG. 1, electrical wiring 20 may have plug 66 and switch 68 to connect the lamp socket 18 to a source of electricity and to control the operation of the lamp.

Figure 6:
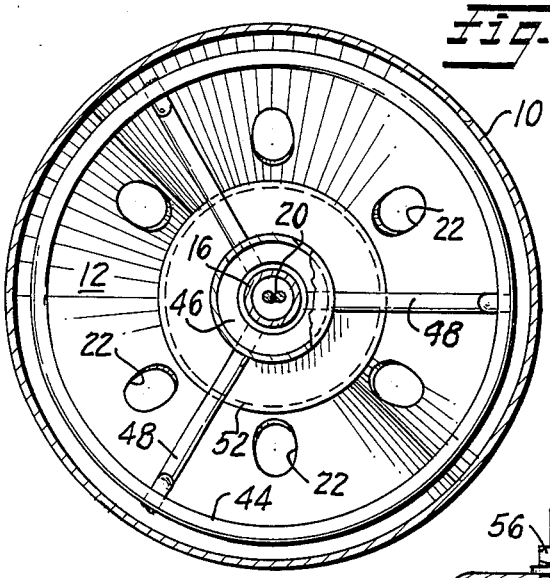
FIG. 6 is a cross-sectional view taken along line 6—6 in FIG. 5.
Figure 4:
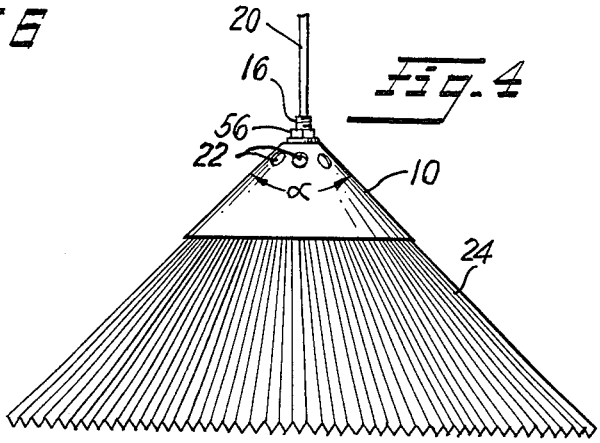
FIG. 4 is an elevational view of the lamp and lamp shade assembly oriented for direct lighting.
Figure 7:
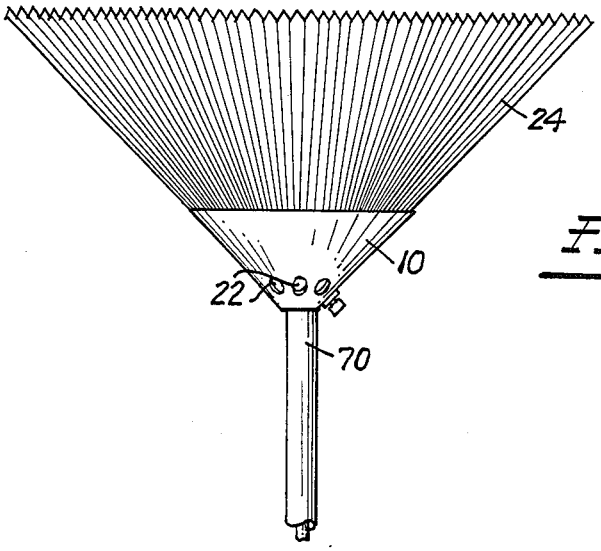
FIG. 7 is an elevational view of the lamp and lamp shade assembly oriented for indirect lighting.

The lamp may be suspended from electrical cord 20 by known means such that body member 10 and lamp shade 24 open in a downward direction, as shown in FIG. 4, to provide direct lighting to a surface below the lamp. Alternatively, the lamp may be mounted on support member 70, as shown in FIG. 7, such that body member 10 and lamp shade 24 open in an upward direction to provide indirect lighting. Support member 70 may be connected to a support base (not shown) to enable the lamp to rest on a floor or table.

From the foregoing, it can be seen that the present invention provides a lamp and lamp shade assembly that is aesthetically pleasing, may be easily assembled and disassembled, and may be utilized in a variety of orientations to provide a variety of lighting effects. The lamp shade 24 may be easily removed from body member 10 merely by unscrewing locking collar 38 and removing retaining member 26. This enables the user to readily replace the lamp shade should it become soiled, or if the user desires to change color or otherwise alter the appearance of the lamp. Although the invention has been described by utilizing an expandable, pleated lamp shade 24, quite obviously other shades may be utilized without exceeding the scope of this invention. Shade 24 may be formed of an expandable, non-pleated material, or it may be a rigid or semi-rigid material pre-formed to the desired conical shape.

It is also envisioned that the lamp and lamp shade assembly according to this invention could be sold or marketed as a kit enabling the purchaser to assemble the structure. The kit would include body member 10, lamp shade 24, retaining ring 26, locking collar 28, spacer member 42 and spacer collar 52. The purchaser could utilize this lamp shade assembly with an existing light socket, or the light socket 18 along with threaded portion 16 and any necessary electrical connections could also be included in the kit.

The foregoing is provided for illustrative purposes only and should not be construed as in any way limiting this invention, the scope of which is defined solely by the appended claims.

What is claimed:

1. A lamp shade assembly for attachment to a lamp socket comprising:

(a) a body member attachable to the lamp socket, the body member having a substantially conical shape defining an apex angle and an interior surface;

(b) a lamp shade having first and second surfaces wherein opposite sides of the lamp shade define an angle between them approximately equal to the apex angle of the body member;

(c) a retaining ring member having a first portion in contact with the second surface of the lamp shade so as to retain the lamp shade in position against the body member such that a portion of the first surface of the lamp shade is in contact with the interior surface of the body member, the retaining ring member comprising:

(i) a plurality of rings each having different diameters; and (ii) a plurality of connecting members connecting the plurality of rings such that the rings are non-coplanar and substantially parallel to each other; and (d) means to attach the retaining ring member to the socket.

2. The lamp shade assembly according to claim 1 wherein the means to attach the retaining member to the lamp socket comprises a locking collar adapted to the threadingly engaged with the lamp socket.

3. The lamp shade assembly according to claim 1 wherein the plurality of rings comprise:

(a) a first ring having a first diameter;

(b) a second ring having a second diameter such that the second diameter is greater than the first diameter; and, (c) a third ring having a third diameter, adapted to pass over a portion of the lamp socket.

4. The lamp shade assembly according to claim 1 further comprising a spacer member interposed between an end of the lamp shade and the body member.

5. The lamp shade assembly according to claim 1 wherein the lamp shade is pleated.

6. The lamp shade assembly according to claim 1 wherein the body member defines a plurality of holes to facilitate the circulation of cooling air through the assembly.

7. A lamp assembly comprising:

(a) a socket having means to operatively connect a light bulb thereto;

(b) means to electrically connect the socket to a source of electricity;

(c) a lamp shade body member having a substantially conical shape defining an apex angle and an interior surface;

(d) a lamp shade having first and second surfaces wherein opposite sides of the lamp shade define an angle between them approximately equal to the apex angle of the body member;

(e) a retaining ring member having a first portion in contact with the second surface of the lamp shade so as to retain the lamp shade in position against the body member such that a portion of the first surface of the lamp shade is in contact with the interior surface of the body member, the retaining ring member comprising;

(i) a plurality of rings each having different diameters; and (ii) a plurality of connecting members connecting the plurality of rings such that the rings are noncoplanar and substantially parallel to each other; and, (f) means to attach the retaining ring member to the socket.

8. The lamp assembly according to claim 7 wherein the means to attach the retaining ring member to the socket comprises a locking collar threadingly engaged with the socket.

9. The lamp assembly according to claim 7 wherein the plurality of rings comprise:

(a) a first ring having a first diameter;

(b) a second ring having a second diameter such that the second diameter is greater than the first diameter; and, (c) a third ring having a third diameter, the third diameter being such that the third ring may pass over a portion of the socket.

10. The lamp assembly according to claim 7 further comprising support means to support the lamp assembly such that a cross-sectional dimension of the conical body member increases in a downward direction.

11. The lamp assembly according to claim 7 further comprising support means to support the lamp assembly such that a cross-sectional dimension of the conical body member increases in an upward direction.

12. The lamp assembly according to claim 7 further comprising a spacer member interposed between an end of the lamp shade and the body member.

13. The lamp assembly according to claim 7 wherein the lamp shade is pleated.

14. The lamp assembly according to claim 7 wherein the body member defines a plurality of holes to facilitate the circulation of cooling air through the assembly.

15. A method of assembling a lamp shade comprising the steps of:

(a) attaching a lamp shade body member having a substantially conical shape to a lamp socket;

(b) orienting the body member such that the portion having the largest cross-sectional dimension faces upwardly;

(c) placing a first end of a generally cylindrical lamp shade in the body member;

(d) inserting a retaining ring member into a second, distal end of the lamp shade such that the distal end of the lamp shade deformes radially outwardly such that the lamp shade assumes a substantially conical shape and is retained between the retaining ring member and the body member; and, (e) attaching the retaining ring member to the lamp socket.

16. The method according to claim 15 comprising the additional step of inserting the body member into an opening defined by a support member so as to hold the body member in its oriented position during assembly, the diameter of the opening being less than the maximum cross-sectional dimension of the body member.

17. A lamp shade kit adapted to be assembled to form a lamp shade comprising:

(a) a body member having a substantially conical shape defining an interior surface and adapted to be attached to a light bulb socket;

(b) a lamp shade having first and second surfaces and adapted to be inserted into the body member;

(c) a retaining ring member adapted to contact a second side of the lamp shade so as to urge the first side of the lamp shade into contact the inner surface of the body member so as to clamp the lamp shade therebetween, the retaining ring member comprising:

(i) a plurality of rings each having different diameters; and (ii) a plurality of connecting members connecting the plurality of rings such that the rings are noncoplanar and substantially parallel to each other; and, (d) a locking collar adapted to engage the light bulb socket so as to attach the retaining ring thereto.

18. The lamp shade kit according to claim 17 further comprising a spacer member adapted to contact a portion of the inner surface of the body member and an end of the lamp shade to position the lamp shade with respect to the body member.

* * * * *